US005258806A

United States Patent [19]

Bares

[11] Patent Number: 5,258,806

[45] Date of Patent: Nov. 2, 1993

[54] PLATEN COVER EDIT PAD FOR SIMPLIFIED DOCUMENT EDITING BEFORE PRINTING

[75] Inventor: Jan Bares, Webster, N.Y.

[73] Assignee: Xerox Corporation, Stamford, Conn.

[21] Appl. No.: 989,436

[22] Filed: Dec. 11, 1992

[51] Int. Cl.[5] ..... G03G 27/62

[52] U.S. Cl. ..... 355/75

[58] Field of Search ..... 355/75, 76, 74, 122, 355/125, 126, 128, 129, 130

[56] References Cited

U.S. PATENT DOCUMENTS

| | | | |
|---|---|---|---|
| 4,538,185 | 8/1985 | Wiggins | 355/75 X |
| 4,540,269 | 9/1985 | Nishiyama | 355/75 X |
| 4,541,713 | 9/1985 | Maekawa | 355/75 |
| 4,595,285 | 6/1986 | Miwa et al. | 355/75 |
| 5,017,963 | 5/1991 | Tuhro | 355/218 |
| 5,142,326 | 8/1992 | Iwata et al. | 355/208 |
| 5,198,859 | 3/1993 | Soma et al. | 355/204 |

*Primary Examiner*—R. L. Moses

*Attorney, Agent, or Firm*—Oliff & Berridge

[57] ABSTRACT

Simplified document editing in a reprographic system allows an operator to edit documents using an edit pad located at the bottom portion of the raised platen cover rather than the conventional method of placing the document on the top of the closed platen cover or some other remote editing location for editing. This eliminates the need to first edit the document and then register it on the platen which, importantly, eliminates the need for handling the document twice and improves document registration. The concept includes retractable registration bars to ensure proper registration of the document to be edited.

8 Claims, 1 Drawing Sheet

PLATEN COVER EDIT PAD FOR SIMPLIFIED DOCUMENT EDITING BEFORE PRINTING

BACKGROUND OF THE INVENTION

1. Field of the Invention

This invention relates to a process and apparatus for simplified document editing before printing in a reprographic system.

2. Description of Related Art

It is desirable to edit a document before it is printed using an electronic reprographic system, especially when using color capable systems. Normally, a document is placed face-up on an edit pad or on top of the platen cover, marked with an editing pen and then at least turned face-down or registered on the platen for copying. Thus, after editing, the operator must register the edited document on the platen.

Therefore, the conventional editing method requires that the operator handle the document at least twice. This extra handling of the original document is time consuming and could cause the document to be misregistered on the platen, thereby introducing needless errors when copying.

Further, the objective of most editing operations is to designate areas of the document copy which the operator wishes to be altered or modified in a designated manner. Such areas are marked with an editing pen designed for this function. The editing pen may be passive, i.e., cordless (though still attached to the device in order to preserve unit integrity) or active, i.e., connected to the copier or edit pad by an electrical cable.

The operator first activates the particular editing function (e.g., delete, change color to red, or another similar instruction) and subsequently touches the document with the editing pen in a prescribed manner. For instance, in a common editing function, the operator touches the upper left corner and lower right corner of a rectangle within the document to be copied, thereby defining a rectangle in which the editing function may be implemented.

For editing a document, there is usually a reserved area, (i.e., an edit pad) on the top of the reprographic printing system, near the platen cover or on the platen cover itself. It may also be a separate device, electronically linked yet set apart from the reprographic system.

In order to define reproducibly the document position, the document must be placed on the edit pad in a defined manner, i.e., registered. This is true of most known editing devices and usually consists of placing the document on a rectangular grid, against protruding stops, with the lower left corner at a designated mark. The edit pad area contains devices which are capable of detecting the position(s) of the editing pen and forwarding this data, for further processing, to the reprographic system controller to modify accordingly the document copying instructions.

Some examples of edit pad technology known in the art include:

1) An edit pad that comprises an array of electrically resistive wires in the X direction overlayed by another such array in the Y direction. Periodically located spacers prevent unintentional contact between the X and Y wires. A flexible, electrically insulative sheet covers this wire grid and represents the edit pad surface. Pressing the cordless editing pen against the document causes contact between the X and Y wires at that location. The processing unit is then capable of calculating X,Y coordinates of the contact point from the resistances of the segments of the contacting wires.

2) In another device, the X and Y wire grid is found as above, however, in this device the reprographic system controller broadcasts electrical pulses sequentially (i.e., into the nth wire, then the n+first wire, and so on). The active editing pen acts as an antenna and the receiver correlates the received pulses with the coordinates of the specific X and Y wires (based on, for instance, timing of the pulses). The detection algorithm places the editing pen at the wire from which the received signal is the strongest and compares it with the signals from neighboring wires and then calculates the position with high accuracy. Clearly, this editing technique would not work with an electrically conducting original document because of the electrical screening of the pen.

3) In still another technique, an active pen that emits a sound when pressed against the original document is employed. The microphones placed on the edit pad periphery receive the sound and calculate the microphone-to-pen distance in a manner similar to that of an active sonar system. The controller then calculates the X and Y coordinates of the pen by triangulation.

4) Finally, some color capable reprographic systems which are capable of differentiating document colors, utilize actual color pen editing. That is, the operator circles with a "red pen" that portion of the document he wishes printed in red. When the document is scanned by the copier, the image processing unit recognizes the red mark and renders the marked document portion in red.

It should be understood that any of the above-described methods of document editing are applicable to the invention described herein. In addition, all similar editing procedures not discussed above are equally applicable for use with this invention.

SUMMARY OF THE INVENTION

It is thus an object of the invention to obviate the foregoing drawbacks of the prior art by providing an improved and simplified document editing method and apparatus for use with a reprographic system.

To achieve the foregoing, and the advantages provided thereby, and to overcome the shortcomings discussed above, a method and apparatus for editing a document before printing in a reprographic system is provided which allows the operator to edit documents from the underside of the platen cover instead of the conventional method of placing the document on top of the platen or using a separate edit pad for editing. The invention eliminates the need to edit and then register the original on the platen.

As described herein, editing is done on the underside (i.e., platen side) of the platen cover, thereby eliminating the need to handle the document twice and improving registration. The concept includes retractable registration bars that ensure proper registration and hold the document in place during editing and copying (the registration bars not being fully retracted until the platen cover is completely lowered onto the platen). The document is then marked (edited) in a conventional manner (similar to those described above) and the platen cover, together with the document and the built-in edit pad, is lowered onto the platen.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENT

The method and apparatus for simplified document editing before printing in a reprographic printing system will now be described.

Figure 1:
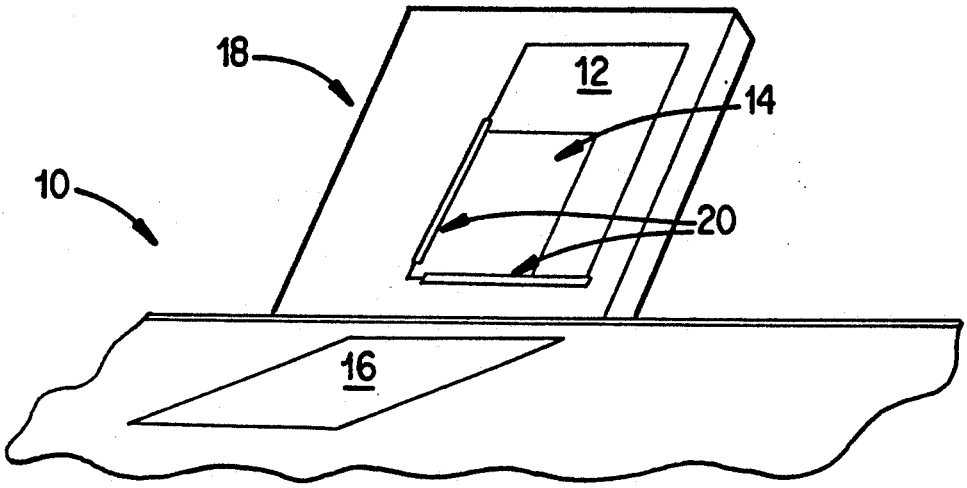
FIG. 1 is a view depicting the top of an electronic reprographic system showing the location of the platen cover edit pad.

FIG. 1 shows an overall view of the top 10 of an exemplary reprographic system, indicating the location of the edit pad 12 and of the document 14 to be edited. Since the document 14 must always be placed on the platen 16 face down for copying, editing has, in the past, required additional manipulation of the document. First, as discussed above, it had to be registered on the edit pad 12 for editing and then placed on the platen 16.

To simplify manipulation, this invention proposes that the edit pad 12 be located on the underside (i.e., platen side) of the platen cover 18. The document 14 is placed into the editing position face-up on the open platen cover 18 against the retractable registration bars 20. It is then marked or edited in the usual manner (as discussed above) and the platen cover 18 together with the built-in edit pad 12 is lowered onto the platen 16. The arrangement eliminates additional handling of the original document 14.

Figure 2:
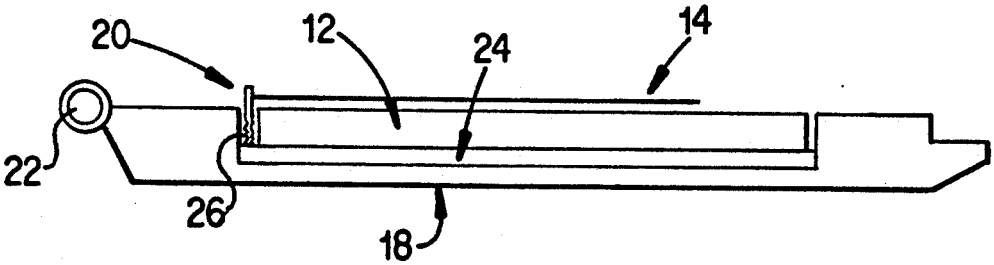
FIG. 2 is a cross-sectional view of the platen cover with the edit pad and retractable registration bars depicted.

FIG. 2 shows the platen cover 18 with the edit pad 12 in cross-section showing a one of the retractable registration bars 20 which are retracted, or seated, when the edit pad 12 and document 14, are pressed against the platen 16. The platen cover hinge axis 22 is also shown.

The registration bars 20 are made of suitable low friction material, such as plastic, and are spring loaded 26 to slide into and out of recesses between the platen cover 18 and the edit pad 12. Additionally, the edit pad 12 surface protrudes slightly out of the bottom plane of the platen cover 18 and is backed by a soft elastic foam material 24 to allow uniform, gentle pressure of the edit pad 12 against the document 14 and the platen 16.

To hold the document in position while the platen is being lowered, several methods can be used with the invention described herein. For example, one method uses electrostatic attractive force by applying a voltage to an electrode array which is disposed behind the edit pad 12 surface. Another method uses a mild suction brought to the document either by small grooves in the edit pad surface, or by a uniform array of holes or both. A blower or other suitable means is used to create a necessary negative pressure.

Thus, using the inventive method and apparatus described herein, an operator first opens the platen cover 18 containing the edit pad 12. The operator registers the document 14 to be edited using the retractable registration bars 20 located at a bottom portion of the underside of the platen cover 18. Next, the operator edits the document 14 (in a recognized manner), which is face-up on the edit pad 12 and, when complete, lowers the platen cover 18 containing the edit pad 12 and the edited document 14 onto the platen 16 surface for printing. In this way, the additional step of editing and then registering the original on the platen has been eliminated, thereby saving time and preventing printing errors due to misregistering.

While the present invention has been described in connection with the preferred embodiment, it will be understood that it is not intended to limit the invention to this embodiment. On the contrary, it is intended to cover all alternatives, modifications and equivalents as may be included within the spirit and scope of the invention as defined by the appended claims.

What is claimed is:

1. An apparatus for editing a document before printing in a reprographic printing system, the apparatus comprising:

a platen cover accommodating an edit means in its bottom portion when said platen cover is in an open position, wherein said edit means is retractable into said platen cover when said platen cover is in a closed position adjacent a platen for printing.

2. The apparatus of claim 1, wherein said open platen cover further comprises:

registration means disposed at least along a side periphery and a bottom periphery for positioning the document for editing and printing.

3. The apparatus of claim 2, wherein said registration means is retractable into said platen cover when said platen cover is in a closed position adjacent a platen.

4. The apparatus of claim 3, wherein said registration means comprises at least two bars made of a low friction material such as smooth plastic.

5. The apparatus of claim 4, wherein said registration means is spring loaded and retracts into said platen cover when pressed against said platen.

6. The apparatus of claim 1, wherein a surface of said edit means protrudes at least slightly out of a plane encompassing a bottom surface of said platen cover.

7. The apparatus of claim 6, wherein said edit means is a pad backed by a soft elastic foam material to allow uniform, gentle pressure of said pad against the document and said platen.

8. A method for editing a document before printing in a reprographic printing system, the method comprising the steps of:

opening a platen cover having an edit means located at a bottom portion of said platen cover;

registering the document to be edited in said edit means;

editing the document which is face-up on the edit means; and lowering said platen cover containing said edit means and the edited document onto a platen for printing.

* * * * *